US005210977A

United States Patent [19]

Werner

[11] Patent Number: 5,210,977

[45] Date of Patent: May 18, 1993

[54] DRILL GRINDING DEVICE

[76] Inventor: Folke Werner, Kommendantsvagen 36, S-291, 36 Kristianstad, Sweden

[21] Appl. No.: 800,618

[22] Filed: Nov. 27, 1991

[30] Foreign Application Priority Data

Dec. 3, 1990 [DE] Fed. Rep. of Germany ..... 4038524

[51] Int. Cl.[5] ..... B24B 7/00

[52] U.S. Cl. ..... 51/129; 51/173; 51/219 R

[58] Field of Search ..... 51/128, 288, 109 R, 51/170 T, 173, 219 R

[56] References Cited

U.S. PATENT DOCUMENTS

| | | | |
|---|---|---|---|
| 3,067,548 | 12/1962 | Winslow | 51/219 R |
| 3,579,924 | 5/1971 | Saito | 51/219 R |
| 3,742,652 | 7/1973 | Enders | 51/128 |
| 3,753,320 | 8/1973 | Wurscher | 51/128 |
| 4,574,528 | 3/1986 | Wurcher | 51/128 |
| 4,676,028 | 6/1987 | Kaczmarski | 51/170 PT |
| 4,858,389 | 8/1989 | Wurscher | 51/219 R |

*Primary Examiner*—M. Rachuba
*Attorney, Agent, or Firm*—Cahill, Sutton & Thomas

[57] ABSTRACT

In a drill grinding device with a grinding surface (7) disposed around a center axis (1), providing a conical grinding surface (8), a drill guide piece (11, 12) opposite the grinding surface with guide channels (13) which are parallel to the center axis for guiding the drills to the grinding surface, the guide channels at least approximately being tangent to an imaginary cylinder periphery (14) equiaxial to the center axis, which cylinder periphery touches the end of the grinding surface which is closest to the drill guide piece. Formation of steps in the grinding wheel due to wear is avoided by the guiding surface (8) forming a point-angled edge (10) at its end, which is closest to the drill guide piece (11, 12), together with the following surface portion (9) of the grinding surface (7).

2 Claims, 2 Drawing Sheets

DRILL GRINDING DEVICE

TECHNICAL FIELD

The invention relates to a drill grinding device.

BACKGROUND ART

Such device is already known from U.S. Pat. No. 4,574,529. In the case of the grinding wheel provided in this patent, the end of the conical grinding surface, which is closest to the drill guide piece, verges into a surface portion of the grinding wheel, which surface is disposed vertically in relation to the center axis.

Based on the specific geometry of twist drills —the highest amount of material to be ground off lies in the periphery of the drills —the most important wear of the grinding wheel happens at the end of the grinding surface which is the closest to the drill guide piece. This wear decreases continuously along with an increasing distance in relation to the drill guide piece. This leads quite soon to the formation of a slightly rounded step in the grinding wheel at said end of the grinding surface and a corresponding convex rounding of the peripheral area of the main cutting edges of the drill and thus gradually deteriorates their cutting properties. Therefore, an adjustment arrangement is provided which uses the areas of the grinding surface correspondingly, which have been less worn by the drills, as well as the surface area of the grinding wheel which is disposed vertically to the center axis, in order to avoid such formation of steps and to preserve the rising angle of the grinding surface.

It is an object of the invention to provide a device for grinding drills in which such formation of steps in the grinding wheel does not occur even without an additional adjustment arrangement being provided. With a device according to the invention, no step can be formed in the grinding wheel at the end which is closest to the drill guide piece, since there is no grinding material outside this end, in radial direction. Thus, the outer ends of the main edges of the drill are not rounded off. The rising angle of the grinding surface decreases and consequently the angle of the drill increases. However, this is tolerable within certain limits.

Certainly devices are known —for example from U.S. Pat. No. 3,753,320 —with a conical grinding surface which forms an acute edge at the end which is closest to the drill guide piece and the following surface portion of the grinding wheel. However, the guide channels are arranged in such a way that their center axes touch the end which is the farthest away from the drill guide piece.

According to another feature of the invention, it is avoided that larger pieces of the grinding wheel could break off at the edge. According to this feature, the surface portion, which forms the edge together with the grinding surface, also has a conical shape.

By another feature of the invention, an especially efficient transport of material from the grinding surface is obtained by the fact that the grinding surface constitutes an outer cone.

BRIEF DESCRIPTION OF THE DRAWINGS

In the following, the invention is explained in more detail by means of an embodiment represented in figures.

DESCRIPTION OF THE PREFERRED EMBODIMENT

Figure 1:
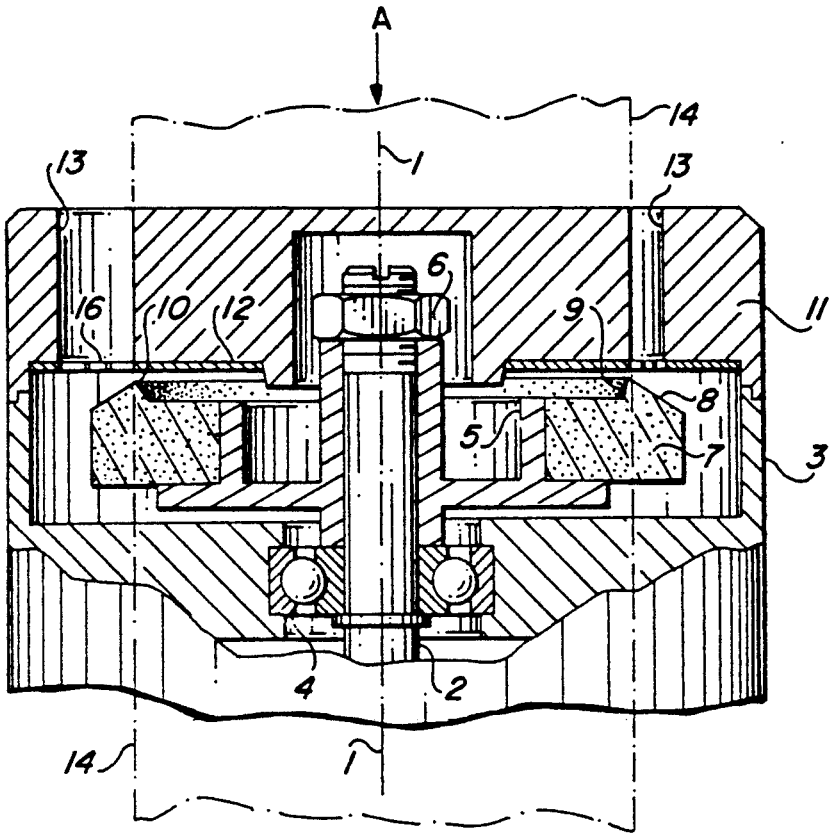
FIG. 1 a longitudinal cross-section of the example of embodiment.
Figure 2:
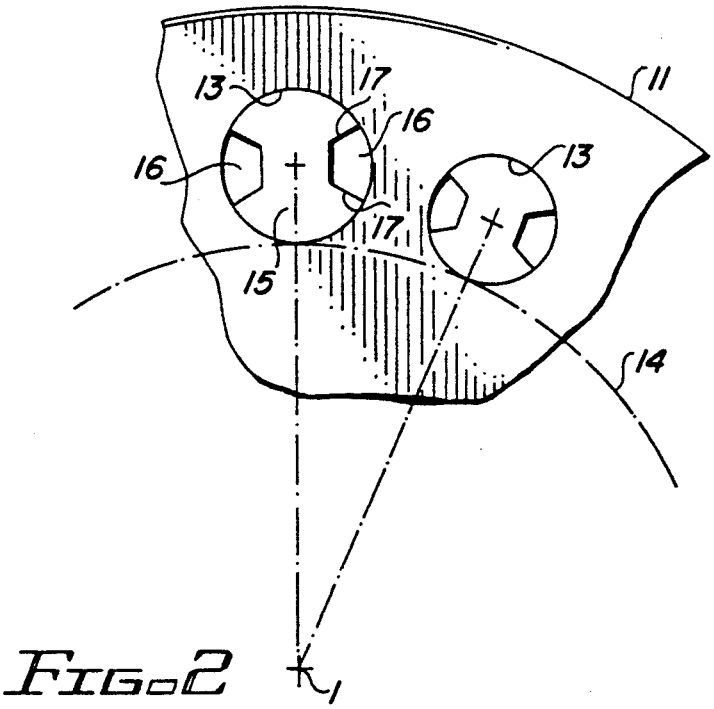
FIG. 2 horizontal projection of two guide channels as seen in the direction of arrow A of FIG. 1, in a larger scale.

An axis 2 represents the spindle of a motor (not shown) disposed in a casing 3. Axis 2 is axially fixed in roller bearings 4. On the axis 2 a grinding wheel carrier 5 is attached between bearing 4 and nut 6.

An annular grinding wheel 7 is glued to the grinding wheel carrier 5. At its flank facing away from the motor the grinding wheel provides an outside-conical grinding surface 8 which forms an acute edge 10 together with an inner cone 9. Together with its rotation plane, the grinding surface 8 forms the angle $\alpha_1$ of 35°, the inner cone 9 forms the angle $\eta$ of 75°. Thus, the acute angle $\gamma$ of 70° is formed at the edge 10.

Opposite the grinding surface 8, a drill guide piece 11, 12 is disposed. It is in rigid connection with the casing 3 and is composed of a guide channel body 11 and a guide projection plate 12 which is in rigid connection with the guide channel body.

The guide channel body 11 provides parallel guide channels 13 which are parallel to the center axis and provide different diameters. These diameters are tangent to an imaginary cylinder circumference 14 coaxial to the center axis 1. The diameter of the cylinder circumference 14 is equal to the diameter of edge 10 of the grinding wheel. The guide projection plate 12 provides openings 15 aligned with the guide channels 13, each with two trapezoidal guide projections 16, designed for engaging the chip grooves 20 of a drill introduced into the guide channel. These trapezoidal projections provide two edges 17 each and have such dimensions that they allow a rotation by approximately 30° around an axis of the drill introduced into the guide channel.

A drill to be ground is inserted manually into the smallest fitting guide channel 13 and between guide projections 16. It is stopped by one of its undercut ground surfaces 18 engaging the rotating grinding surface 8. The periphery of the drill nearly touches the edge 10. The drill is slightly pressed against the grinding surface and will now be turned back and forth a few times between stopping edges 17 of the guide projection. After this the drill is withdrawn, turned by 180° and again introduced all the way up to the grinding surface and again turned back and forth. Now both undercut surfaces are ground.

Figure 5:
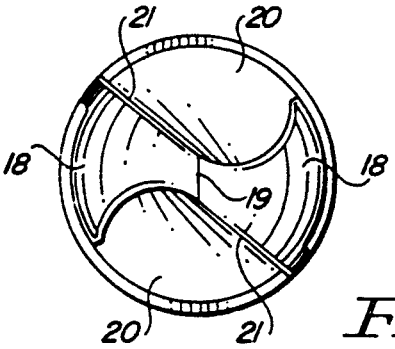
FIG. 5 shows a horizontal projection of the top of a drill. The different parts of the embodiment are disposed concentrically around the center axis 1.

Based on the special geometry of a twist drill (see FIG. 5), the wear of the grinding wheel is most severely directly at the edge 10 and decreases continuously with an increased distance in relation to the edge. Wear of the grinding wheel is slow in the area of the cross-edge 19 of the drill. The rising angle $\alpha$ of the grinding wheel 8 will therefore decrease with an increasing wear of the grinding wheel. As soon as the rising angle $\alpha$ of the grinding surface has decreased down to a value of 30°

Figure 3:
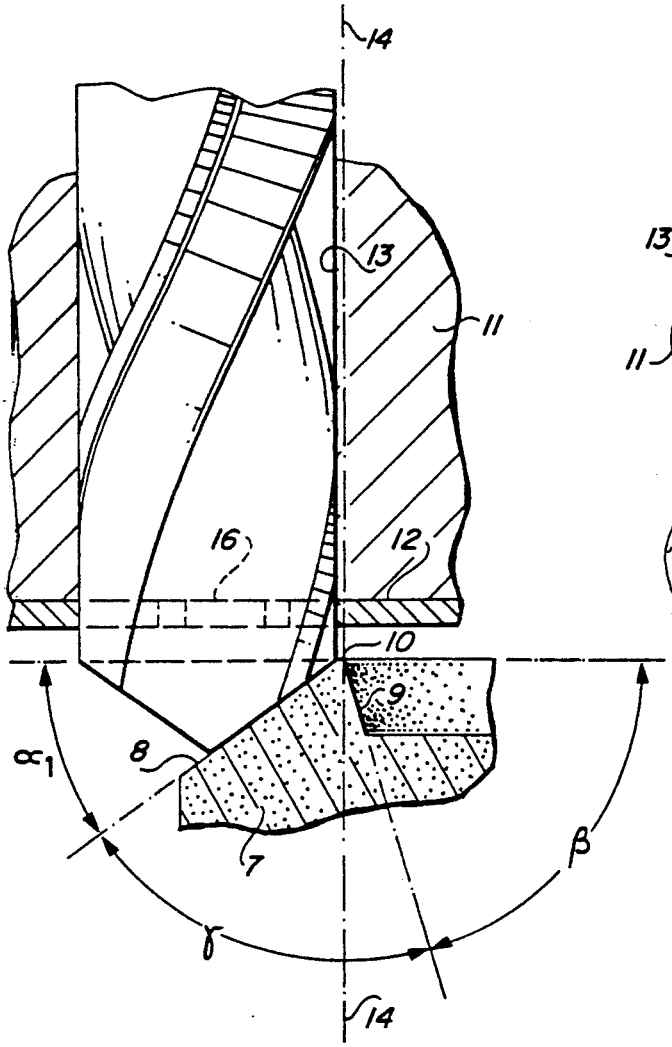
FIG. 3 a portion of FIG. 1 with a drill having entered a guiding channel up to the grinding surface, in a larger scale.
Figure 4:
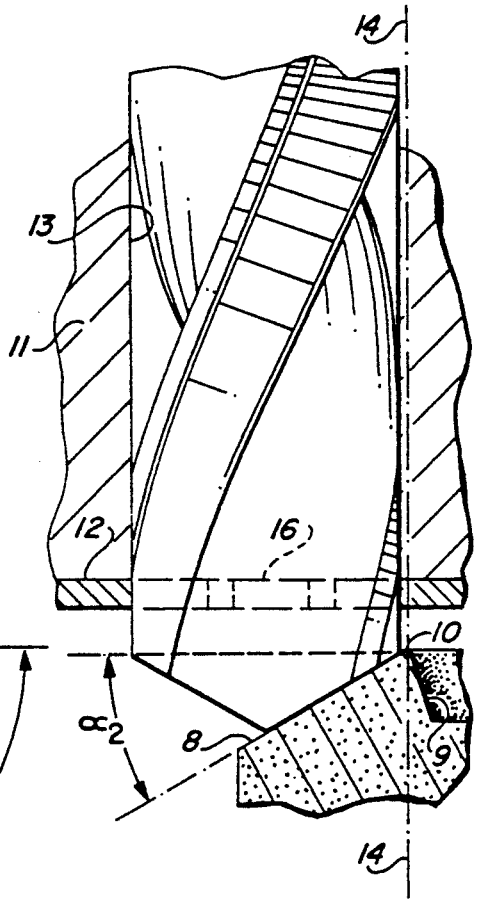
FIG. 4, the same as FIG. 3, only after a longer wear of the grinding wheel.

($\alpha_2$ in FIG. 4), the grinding wheel will be exchanged. A step in the grinding wheel near the edge of the grinding surface, however, cannot be formed, since outside the end of the grinding surface, as seen in radial direction, no grinding wheel material is provided. The main edges 21 of the drills will always remain straight. A certain excess projection of the position of the edge 10 in relation to the drill periphery —see FIG. 3 and 4 —however, which depends on the grain size in the grinding body used, is not disadvantageous, since it crumbles away.

Therefore, the rising angle $\beta$ of the inner conical surface portion 9 of the grinding wheel has to be selected in such a way, that on one hand a break-off of larger pieces of the grinding wheel at the edge 10 can be avoided, while on the other hand the mentioned excess projection of the edge 10 should not become too great as the grinding wheel is progressively worn.

When the grinding surface is rotating, loose material is tossed away due to the effect of the centrifugal force of the outer conical grinding surface 8.

What is claimed is:

1. Device for grinding twist drills having undercut ground surfaces (18) and a chip groove (20) for each undercut ground surface, said device comprising a center axis (1), a grinding wheel (7) disposed rotatably around said center axis, said grinding wheel having a cone-shaped grinding surface (8), said device further comprising a drill guide piece (11, 12) disposed opposite said grinding surface and around and provided with guide channels (13) extending parallel to said center axis, said center axis, with guide projections (16) engaging with the chip grooves for the axial guidance of the undercut ground surfaces (18) of the drill relative to the grinding surface and for the radial guidance of said undercut ground surfaces (18) of the drills relative to the grinding surface, the guide channels being tangent at least approximately to an imaginary cylinder circumference (14) which is coaxial with the center axis, which cylinder circumference encounters the end of said grinding surface, which is closest to the drill guide piece (11, 12), characterized in that an acute-angled edge (10) is formed by the grinding surface (8) at its end which is closest to said drill guide piece (11, 12) together with the following surface portion (9) of the grinding wheel (7).

2. Device according to claim 1, characterized in that the surface portion (9) of said grinding wheel (7) which forms said acute angled edge (10) also has a conical shape.

* * * * *